US008194003B2

(12) United States Patent
Kim et al.

(10) Patent No.: US 8,194,003 B2
(45) Date of Patent: Jun. 5, 2012

(54) PLASMA DISPLAY DEVICE WITH LINE LOAD COMPENSATION AND DRIVING METHOD THEREOF

(75) Inventors: Jin-Sung Kim, Suwon-si (KR); Hyuk-Jae Lee, Seoul (KR)

(73) Assignees: Samsung SDI Co., Ltd., Yongin-si (KR); Seoul National University Industry Foundation, Seoul (KR)

( * ) Notice: Subject to any disclaimer, the term of this patent is extended or adjusted under 35 U.S.C. 154(b) by 742 days.

(21) Appl. No.: 11/677,552

(22) Filed: Feb. 21, 2007

(65) Prior Publication Data

US 2007/0200798 A1 Aug. 30, 2007

(30) Foreign Application Priority Data

Feb. 28, 2006 (KR) ..... 10-2006-0019236

(51) Int. Cl.
*G09G 3/28* (2006.01)

(52) U.S. Cl. ..... 345/60; 345/63

(58) Field of Classification Search ..... 345/60–68; 315/169.4

See application file for complete search history.

(56) References Cited

U.S. PATENT DOCUMENTS

| | | | | |
|---|---|---|---|---|
| 7,126,562 | B1 * | 10/2006 | Irie et al. | 345/63 |
| 2005/0088372 | A1 * | 4/2005 | Lee et al. | 345/60 |
| 2005/0140580 | A1 * | 6/2005 | Baik et al. | 345/60 |
| 2005/0140584 | A1 * | 6/2005 | Kim et al. | 345/60 |
| 2005/0200571 | A1 | 9/2005 | Gotoda et al. | |
| 2005/0212727 | A1 * | 9/2005 | Lee | 345/63 |
| 2005/0231444 | A1 * | 10/2005 | Takeuchi et al. | 345/63 |
| 2006/0038748 | A1 | 2/2006 | Chiu et al. | |
| 2006/0132659 | A1 * | 6/2006 | Kimura et al. | 348/631 |

FOREIGN PATENT DOCUMENTS

| | | | |
|---|---|---|---|
| EP | 1 400 947 | A2 | 3/2004 |
| EP | 1 667 094 | A1 | 6/2006 |
| JP | 8-32903 | | 2/1996 |
| JP | 2004-301964 | | 10/2004 |
| JP | 2005-257754 | | 9/2005 |
| KR | 10-2004-0085355 | | 10/2004 |
| KR | 10-2005-0014046 | | 2/2005 |

(Continued)

OTHER PUBLICATIONS

Park, S., et al., *An Optimum Selection of Subfield Pattern for Plasma Displays Based on Genetic Algorithm*, IEICE Trans. Electron., vol. E84-C, No. 11, Nov. 2001, pp. 1659-1666.

(Continued)

*Primary Examiner* — Chanh Nguyen
*Assistant Examiner* — Sanghyuk Park
(74) *Attorney, Agent, or Firm* — Christie, Parker & Hale, LLP

(57) ABSTRACT

In a plasma display device, one frame is divided into a plurality of subfields having respective luminance weights, and a first line load ratio is measured from a plurality of video signals corresponding to a first row electrode among a plurality of row electrodes during the respective subfields. A first output estimation weight of each subfield is set based on the first line load ratio of each subfield in the first row electrode. The plurality of video signals corresponding to the first row electrode are converted into a plurality of first subfield data based on the first output estimation weight, and a driving signal is applied to the first row electrode and the plurality of column electrodes according to the plurality of first subfield data.

17 Claims, 13 Drawing Sheets

FOREIGN PATENT DOCUMENTS

KR 10-2005-0113875 12/2005

OTHER PUBLICATIONS

Patent Abstracts of Japan, Publication No. 08-032903 dated Feb. 2, 1996 in the name of Tetsuro Nagakubo.

Patent Abstracts of Japan, Publication No. 2004-301964, dated Oct. 28, 2004 in the name of Ryuhei Amano et al.

Patent Abstracts of Japan, Publication No. 2005-257754, dated Sep. 22, 2005 in the name of Akira Gotoda et al.

Korean Patent Abstracts, Publication No. 1020050014046 A, dated Feb. 7, 2005 in the name of Kyung Tae Kim.

Korean Patent Abstracts, Publication No. 1020050113875 A, dated Dec. 5, 2005 in the name of Jin Sung Kim et al.

European Search Report dated Nov. 18, 2010, for corresponding European Patent application 06122099.2.

European Patent Office Action dated Jul. 7, 2011, in corresponding Application No. 06122099.2, 5 shts.

European Search Report dated Jul. 4, 2007, for EP 06122099.2, in the name of Samsung SDI Co., Ltd., et al.

Park, S., et al., *An Optimum Selection of Subfield Pattern of Plasma Displays Based on Genetic Algorithm*, IEICE Transactions on Electronics, vol. E84-C, No. 11, Nov. 2001, pp. 1659-1666, XP001110776 (1 page Summary only).

* cited by examiner

| Subfield | SF1 | SF2 | SF3 | SF4 | SF5 | SF6 | SF7 | SF8 | SF9 | SF10 | SF11 |
|---|---|---|---|---|---|---|---|---|---|---|---|
| Luminance weight | 1 | 2 | 3 | 5 | 10 | 18 | 34 | 60 | 90 | 130 | 158 |

FIG. 7A

| Video data / Subfield | SF1 | SF2 | SF3 | SF4 | SF5 | SF6 | SF7 | SF8 | SF9 | SF10 | SF11 | Actual luminance | Target luminance | Error | Error ratio (%) |
|---|---|---|---|---|---|---|---|---|---|---|---|---|---|---|---|
| Weight | 1 | 2 | 3 | 5 | 10 | 18 | 34 | 60 | 90 | 130 | 158 | | | | |
| 5 | 0 | 1 | 1 | 0 | 0 | 0 | 0 | 0 | 0 | 0 | 0 | 5.10 | 5 | 0.10 | 1.94 |
| 10 | 0 | 1 | 1 | 1 | 0 | 0 | 0 | 0 | 0 | 0 | 0 | 10.27 | 10 | 0.27 | 2.66 |
| 15 | 0 | 1 | 1 | 0 | 1 | 0 | 0 | 0 | 0 | 0 | 0 | 15.89 | 15 | 0.89 | 5.96 |
| 20 | 0 | 1 | 1 | 1 | 1 | 0 | 0 | 0 | 0 | 0 | 0 | 21.06 | 20 | 1.06 | 5.31 |
| 25 | 0 | 1 | 0 | 1 | 0 | 1 | 0 | 0 | 0 | 0 | 0 | 27.74 | 25 | 2.74 | 10.97 |
| 120 | 1 | 1 | 0 | 1 | 0 | 1 | 1 | 1 | 0 | 0 | 0 | 136.35 | 120 | 16.35 | 13.63 |
| 140 | 1 | 1 | 1 | 0 | 1 | 0 | 1 | 0 | 1 | 0 | 0 | 166.11 | 140 | 26.11 | 18.65 |
| 120 | 1 | 1 | 0 | 1 | 0 | 1 | 1 | 1 | 0 | 0 | 0 | 136.35 | 120 | 16.35 | 13.63 |
| 80 | 0 | 1 | 1 | 1 | 1 | 0 | 0 | 1 | 0 | 0 | 0 | 89.66 | 80 | 9.66 | 12.07 |
| 20 | 0 | 1 | 1 | 1 | 1 | 0 | 0 | 0 | 0 | 0 | 0 | 21.06 | 20 | 1.06 | 5.31 |
| Line load ratio (%) | 30 | 100 | 70 | 70 | 50 | 30 | 30 | 30 | 10 | 0 | 0 | | | | |
| Output estimation weight | 1.14 | 2.00 | 3.10 | 5.17 | 10.80 | 20.58 | 38.87 | 68.60 | 110.20 | 165.32 | 200.93 | | | | |

FIG. 7B

| Video data / Subfield | SF1 | SF2 | SF3 | SF4 | SF5 | SF6 | SF7 | SF8 | SF9 | SF10 | SF11 | Actual luminance | Target luminance | Error | Error ratio (%) |
|---|---|---|---|---|---|---|---|---|---|---|---|---|---|---|---|
| Weight | 1.14 | 2.00 | 3.10 | 5.17 | 10.80 | 20.58 | 38.87 | 68.60 | 110.20 | 165.32 | 200.93 | | | | |
| 5 | 0 | 1 | 1 | 0 | 0 | 0 | 0 | 0 | 0 | 0 | 0 | 5.17 | 5.10 | 0.07 | 1.41 |
| 10 | 0 | 1 | 1 | 1 | 0 | 0 | 0 | 0 | 0 | 0 | 0 | 10.72 | 10.27 | 0.45 | 4.38 |
| 15 | 1 | 0 | 1 | 0 | 1 | 0 | 0 | 0 | 0 | 0 | 0 | 14.58 | 15.04 | -0.46 | -3.05 |
| 20 | 1 | 0 | 1 | 1 | 1 | 0 | 0 | 0 | 0 | 0 | 0 | 20.13 | 20.21 | -0.08 | -0.40 |
| 25 | 0 | 1 | 1 | 0 | 0 | 1 | 0 | 0 | 0 | 0 | 0 | 25.75 | 25.68 | 0.07 | 0.28 |
| 120 | 0 | 1 | 0 | 0 | 1 | 0 | 1 | 1 | 0 | 0 | 0 | 118.72 | 120.26 | -1.54 | -1.28 |
| 140 | 0 | 1 | 0 | 0 | 1 | 1 | 1 | 1 | 0 | 0 | 0 | 139.29 | 140.84 | -1.54 | -1.10 |
| 120 | 0 | 1 | 0 | 0 | 1 | 0 | 1 | 1 | 0 | 0 | 0 | 128.72 | 120.26 | -1.54 | -1.28 |
| 80 | 0 | 1 | 1 | 1 | 1 | 1 | 1 | 0 | 0 | 0 | 0 | 79.35 | 80.51 | -1.17 | -1.45 |
| 20 | 1 | 0 | 1 | 1 | 1 | 0 | 0 | 0 | 0 | 0 | 0 | 20.13 | 20.21 | -0.08 | -0.40 |
| Line load ratio (%) | 30 | 70 | 70 | 40 | 70 | 30 | 40 | 30 | 0 | 0 | 0 | | | | |
| Output estimation weight | 1.14 | 2.07 | 3.10 | 5.55 | 10.34 | 20.58 | 37.72 | 68.60 | 114.45 | 165.32 | 200.93 | | | | |

FIG. 8A

| Subfield (SF) | 1 | 2 | 3 | 4 | 5 | 6 | 7 | 8 | 9 | 10 | 11 | Target luminance | Actual luminance |
|---|---|---|---|---|---|---|---|---|---|---|---|---|---|
| Calculation weight | 1 | 2 | 3 | 5 | 8 | 12 | 19 | 28 | 40 | 59 | 78 | | |
| Output estimation weight | 1 | 2 | 2.99 | 5.07 | 7.99 | 11.98 | 18.97 | 33.42 | 47.74 | 70.42 | 93.1 | | |
| 250 grayscale | 1 | 1 | 1 | 0 | 1 | 1 | 1 | 1 | 1 | 1 | 1 | 250 | 289 |
| 50 grayscale | 1 | 1 | 1 | 1 | 1 | 1 | 1 | 0 | 0 | 0 | 0 | 50 | 50 |
| Line load ratio (%) | 100% | 100% | 100% | 83% | 100% | 100% | 100% | 17% | 17% | 17% | 17% | | |

FIG. 8B

| Subfield (SF) | 1 | 2 | 3 | 4 | 5 | 6 | 7 | 8 | 9 | 10 | 11 | Target luminance | Actual luminance |
|---|---|---|---|---|---|---|---|---|---|---|---|---|---|
| Calculation weight | 1 | 2 | 2.99 | 5.07 | 7.99 | 11.98 | 18.97 | 33.42 | 47.74 | 70.42 | 93.1 | | |
| Output estimation weight | 1 | 2.39 | 3.04 | 4.99 | 8.11 | 14.32 | 22.68 | 28.4 | 47.74 | 70.42 | 93.1 | | |
| 250 grayscale | 1 | 1 | 0 | 1 | 0 | 1 | 1 | 0 | 1 | 1 | 1 | 250 | 256.64 |
| 50 grayscale | 1 | 0 | 1 | 1 | 1 | 0 | 0 | 1 | 0 | 0 | 0 | 50 | 45.54 |
| Line load ratio (%) | 100% | 17% | 83% | 100% | 83% | 17% | 17% | 83% | 17% | 17% | 17% | | |

FIG. 11

| Subfield (SF) | 1 | 2 | 3 | 4 | 5 | 6 | 7 | 8 | 9 | 10 | 11 | Target luminance | Actual luminance |
|---|---|---|---|---|---|---|---|---|---|---|---|---|---|
| Calculation weight | 1 | 2 | 2.99 | 5.07 | 7.99 | 11.98 | 18.97 | 33.42 | 47.74 | 70.42 | 93.1 | | |
| Output estimation weight | 1 | 2 | 3.04 | 4.99 | 8.11 | 11.98 | 18.96 | 35.61 | 47.74 | 70.45 | 93.14 | | |
| 250 grayscale | 1 | 1 | 0 | 1 | 0 | 1 | 1 | 0 | 1 | 1 | 1 | 250 | 250.28 |
| 50 grayscale | 1 | 1 | 1 | 1 | 1 | 1 | 1 | 0 | 0 | 0 | 0 | 50 | 50.08 |
| Line load ratio (%) | 100% | 100% | 83% | 100% | 83% | 100% | 100% | 0% | 17% | 17% | 17% | | |

PLASMA DISPLAY DEVICE WITH LINE LOAD COMPENSATION AND DRIVING METHOD THEREOF

CROSS-REFERENCE TO RELATED APPLICATION

This application claims priority to and the benefit of Korean Patent Application No. 10-2006-0019236 filed in the Korean Intellectual Property Office on Feb. 28, 2006, the entire content of which is incorporated herein by reference.

BACKGROUND OF THE INVENTION (a) Field of the Invention

The present invention relates to a plasma display device and a driving method thereof. More particularly, the present invention relates to a method for allocating a sustain pulse to a plurality of subfields that form one frame.

(b) Description of the Related Art

A plasma display device is a flat panel display device that uses plasma generated by a gas discharge process to display characters or images. In general, one frame of the plasma display device is divided into a plurality of subfields, each having a corresponding brightness weight, to drive the plasma display device. Turn-on/turn-off cells (i.e., cells to be turned on or off) are selected during an address period of each subfield, and a sustain discharge operation is performed on the turn-on cells to display an image during a sustain period. Grayscales are expressed by a combination of weights of the subfields that are used to perform a display operation.

In a display panel of the plasma display device, a plurality of row electrodes and a plurality of column electrodes are formed, and discharge cells are formed where the row electrodes cross the column electrodes. Accordingly, currents flowing to the row electrodes vary according to the number of the turn-on cells along the row electrode, and a voltage drop occurs according to the currents. The voltage drop is reduced as the number of turn-on cells of the row electrode is reduced and luminance in one discharge cell is increased when the voltage drop is reduced. That is, since the luminance expressed by one subfield varies according to the number of turn-on cells of the row electrodes, a luminance deviation at the row electrode may occur for the same gray scale.

SUMMARY OF THE INVENTION

The present invention provides a plasma display device for preventing a luminance deviation caused by a line load ratio, and a driving method thereof.

According to an embodiment of the present invention, subfield data are compensated according to the line load ratio.

An exemplary embodiment of the present invention provides a plasma display device including a plurality of row electrodes, a plurality of column electrodes, and a plurality of discharge cells defined by the plurality of row electrodes and the plurality of column electrodes, and a driving method thereof. In the driving method, one frame is divided into a plurality of subfields having respective luminance weights, and a first line load ratio in each subfield is determined from a plurality of video signals corresponding to a first row electrode among the plurality of row electrodes. A first output estimation weight of each subfield is set based on the first line load ratio of each subfield in the first row electrode. Subsequently, a plurality of video signals corresponding to the first row electrode are respectively converted into a plurality of first subfield data based on the first output estimation weight, and a driving signal is applied to the first row electrode and the plurality of column electrodes according to the plurality of first subfield data.

In this case, the first line load ratio in each subfield is determined from a plurality of video signals that are mapped into an initial set of subfield data. Further, each subfield has an initial luminance weight. The initial subfield weights are updated by the above method to produce the output estimation weight. The initial subfield data are updated according to the updated subfield weights to yield the first subfield data. Also, the plurality of video signals corresponding to the first row electrode may be mapped into the plurality of subfields having the respective luminance weights, and are converted into a plurality of second subfield data. The first line load ratio of each subfield may be determined from the plurality of second subfield data.

In addition, at least one model for changes of output luminance depending on changes of the line load ratio may be generated, the at least one model is used, and the first output estimation weight of the plurality of subfields may be calculated from the luminance weight and the plurality of first line load ratios.

The plurality of video signals corresponding to the first row electrode may be mapped into the plurality of subfields having the respective first output estimation weights, and the video signals may be converted into the plurality of first subfield data.

The plurality of video signals corresponding to the first row electrode may be mapped into the plurality of subfields having the respective first output estimation weights, and the video signals may be mapped into a plurality of second subfield data. In this case, the plurality of video signals corresponding to the first row electrode are mapped into the plurality of subfields having the respective first output estimation weights, the video signals are converted into a plurality of third subfield data, an error between the luminance weight and the first output estimation weight of each subfield is calculated for the first row electrode, second subfield data are set as the first subfield data in a subfield having the error that is less than a threshold value among the plurality of subfields, and third subfield data are set as the first subfield data in a subfield having the error that is greater than the threshold value.

The plurality of video signals corresponding to the first row electrode are mapped into the plurality of subfields having the respective first output estimation weights, the video signals are converted into a plurality of second subfield data, a second line load ratio of each subfield is determined from the plurality of second subfield data. At least some subfields are detected among subfields having an error between the first line load ratio and the second line load ratio that is greater than a threshold value corresponding to the respective subfields, the at least some subfields are set as a basic load, and the second line load ratio is compensated in a subfield group having the basic load. Subsequently, a second output estimation weight is set based on the compensated second line load ratio, the plurality of video signals corresponding to the first row electrode are mapped into the plurality of subfields having the respective second output estimation weights, and the video signals are converted to the plurality of first subfield data.

An exemplary plasma display device according to an exemplary embodiment of the present invention includes a row electrode having a plurality of discharge cells, a controller, and a driver. The controller divides one frame into a plurality of subfields having respective luminance weights, maps a plurality of video signals respectively corresponding to the plurality of discharge cells into the plurality of subfields, converts the video signals into a plurality of first subfield data, measures a line load ratio of each subfield from the plurality of first subfield data, respectively compensates the plurality of first subfield data according to the line load ratio of each subfield, and generates a plurality of second subfield data. The driver discharges a plurality of turn-on cells based on the plurality of second subfield data in the plurality of subfields having the luminance weight. When the second subfield data are generated using the subfield data of one frame, they will be used to generate the sustain pulses.

An exemplary plasma display device according to another embodiment of the present invention includes a plurality of row electrodes respectively having a plurality of discharge cells, a controller, and a driver. The controller may divide one frame into a plurality of subfields having respective luminance weights, calculate a screen load ratio from a plurality of video signals corresponding to the one frame, calculate a line load ratio for each subfield of the respective row electrodes from the plurality of video signals corresponding to the respective row electrodes, respectively compensate the plurality of video signals according to the line load ratio of the row electrode in the discharge cell corresponding to the screen load ratio, and generate a plurality of subfield data.

In this case, the controller may convert the video signal of a first grayscale corresponding to a row electrode having a first line load ratio into first subfield data in a first frame having a first screen load ratio, and convert a video signal of a second grayscale that is equal to the first grayscale corresponding to a row electrode having a second line load ratio that is equal to the first line load ratio into second subfield data that are different from the first subfield data in a second frame having a second screen load ratio that is different from the first screen load ratio.

In addition, the controller may convert the video signal of a first grayscale corresponding to a row electrode having a first line load ratio into first subfield data, and convert the video signal of a second grayscale that is equal to the first grayscale corresponding to a row electrode having a second line load ratio that is different from the first line load ratio into second subfield data that are different from the first subfield data.

An exemplary plasma display device according to a further embodiment of the present invention includes a row electrode at least having a plurality of first discharge cells emitting a first color and a plurality of second discharge cells emitting a second color, a controller, and a driver. The controller divides one frame into a plurality of subfields having respective luminance weights, calculates a line load ratio for each subfield of the row electrode from a plurality of video signals respectively corresponding to the plurality of first and second discharge cells, respectively compensates the plurality of video signals according to the line load ratio and the first and second colors, and generates a plurality of subfield data.

BRIEF DESCRIPTION OF THE DRAWINGS

FIG. 7A shows a diagram representing subfield weights and subfield data before the luminance is compensated in the method shown in FIG. 6.

FIG. 7B shows a diagram representing the subfield weights and subfield data after the luminance is compensated in the method shown in FIG. 6.

FIG. 8A shows a diagram representing the subfield weights and the subfield data before the luminance is compensated in the method shown in FIG. 6.

FIG. 8B shows a diagram representing the subfield weights and subfield data after the luminance is compensated in the method shown in FIG. 6.

FIG. 11 shows a diagram representing the subfield data after the data shown in FIG. 8A are compensated in the method shown in FIG. 10.

DETAILED DESCRIPTION

Figures 1, 2:
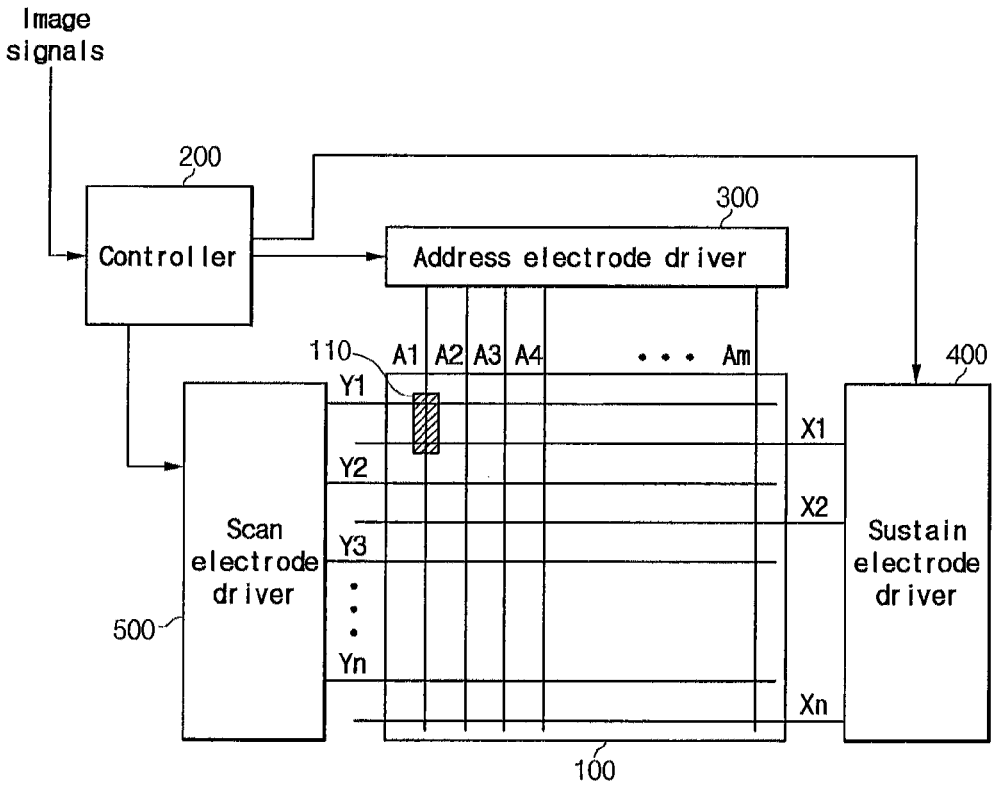
FIG. 1 shows a schematic diagram of a plasma display device according to a first exemplary embodiment of the present invention.
FIG. 2 shows a diagram representing a subfield arrangement according to the first exemplary embodiment of the present invention.

As shown in FIG. 1, the plasma display device according to the first exemplary embodiment of the present invention includes a plasma display panel (PDP) 100, a controller 200, an address electrode driver 300, a sustain electrode driver 400, and a scan electrode driver 500.

The PDP 100 includes a plurality of address electrodes (hereinafter, referred to as A electrodes) A1 to Am extending in a column direction, and a plurality of sustain and scan electrodes (hereinafter, referred to as X and Y electrodes) X1 to Xn and Y1 to Yn in pairs extending in a row direction. In general, the X electrodes X1 to Xn respectively correspond to the Y electrodes Y1 to Yn, and neighboring X and Y electrodes form a row electrode. The Y and X electrodes Y1 to Yn and X1 to Xn are arranged perpendicular to the A electrodes A1 to Am, and a discharge space formed at an area where the address electrodes A1 to Am cross the sustain and scan electrodes X1 to Xn and Y1 to Yn forms a discharge cell 110. The electrodes cross over or under and do not intersect. Since phosphor layers of red, green, and blue are alternately formed along a row direction and corresponding to the A electrodes A1 to Am, it is assumed that discharge cells of red, green, and blue are alternately arranged in the PDP 100 along the row direction.

The PDP 100 is driven during frames of time. The controller 200 divides one frame into a plurality of subfields SF1 to SF11 each having a corresponding luminance weight as shown in FIG. 2. Further, each subfield includes an address period and a sustain period. In addition, the controller 200 converts a plurality of video data for the plurality of discharge cells 110 into subfield data indicating respective light emitting/non-light emitting states in the plurality of subfields SF1 to SF11. In FIG. 2, one frame includes 11 subfields SF1 to SF11 respectively having luminance weights of 1, 2, 3, 5, 10, 18, 34, 60, 90, 130, and 158, using which grayscales from 0 to 511 may be expressed. For example, the controller 200 may convert video data of 120 grayscale into subfield data of "00110111000". Here, "00110111000" sequentially corresponds to the respective subfields SF1 to SF11, 1 indicates that the discharge cell is light-emitted in the corresponding subfield, and 0 indicates that the discharge cell is not light-emitted in the corresponding subfield. If the subfields are assigned the luminance weights shown in FIG. 2, then the grayscale of 120 may be obtained by $0\times1+0\times2+1\times3+1\times5+0\times10+1\times1\times18+1\times34+1\times60+0\times90+0\times130+0\times158=3+5+18+34+60=120$. The same grayscale 120, however, may also be obtained by a different combination of subfields during which the discharge cell emits light.

In this case, the controller 200 measures line load ratios of the row electrodes from the generated subfield data, and determines output estimation weights of the respective subfields SF1 to SF11 according to the measured line load ratios. The output estimation weights are the updated and newly estimated luminance weights of each subfield. In addition, the controller 200 converts the video data to the subfield data according to the measured output estimation weights of the respective subfields SF1 to SF11, and applies driving control signals to the A, X, and Y electrode drivers 300, 400, and 500 according to the subfield data.

The A, X, and Y electrode drivers 300, 400, and 500 respectively apply driving voltages to the A, X, and Y electrodes A1 to Am, X1 to Xn, and Y1 to Yn according to the driving control signals from the controller 200. In further detail, during the address period in each subfield, the A, X, and Y electrode drivers 300, 400, and 500 select turn-on cells and turn-off cells from among the plurality of discharge cells 110. During the sustain period of each subfield, the X and/or the Y electrode drivers 400 and 500 apply a sustain pulse to the plurality of X electrodes X1 to Xn and/or the plurality of Y electrodes Y1 to Yn a number of times corresponding to the weight of the subfield, and a sustain discharge is repeatedly performed for the turn-on cell.

A method for compensating luminance by determining the output estimation weight of the respective subfields SF1 to SF11 by the controller 200 will now be described with reference to FIG. 3A to FIG. 14.

Luminance variations caused according to a screen load ratio and a line load ratio when a screen is displayed according to the subfield data determined by an initial subfield weight without compensating the luminance according to the first exemplary embodiment of the present invention is first described with reference to FIG. 3A, FIG. 3B, FIG. 4A, FIG. 4B, and FIG. 4C.

Figure 3A:
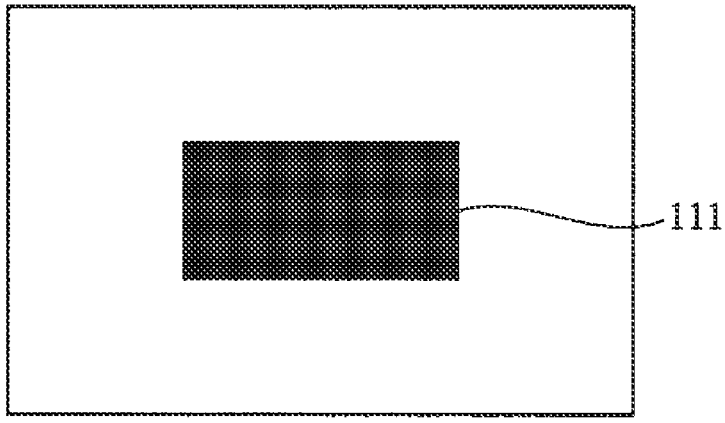
FIG. 3A shows a diagram representing a screen to be displayed.
Figure 3B:
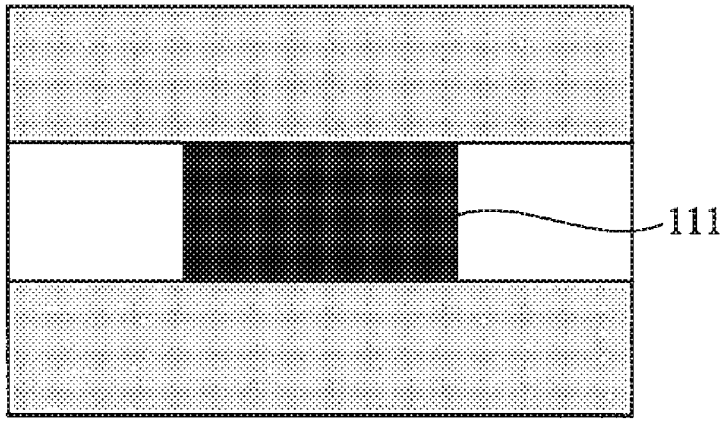
FIG. 3B shows a diagram representing a screen perceived by eye when the screen shown in FIG. 3A is actually displayed.
Figure 4A:
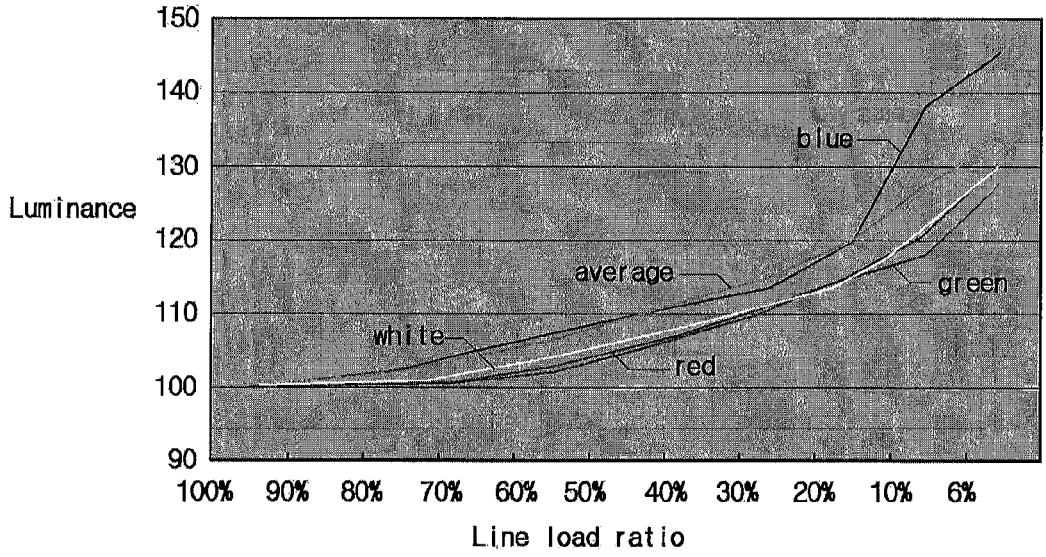
FIG. 4A, FIG. 4B, and FIG. 4C show graphs representing luminance variations according to line load ratios for three screen load ratios of 90%, 60%, and 30%, respectively.
Figure 4B:
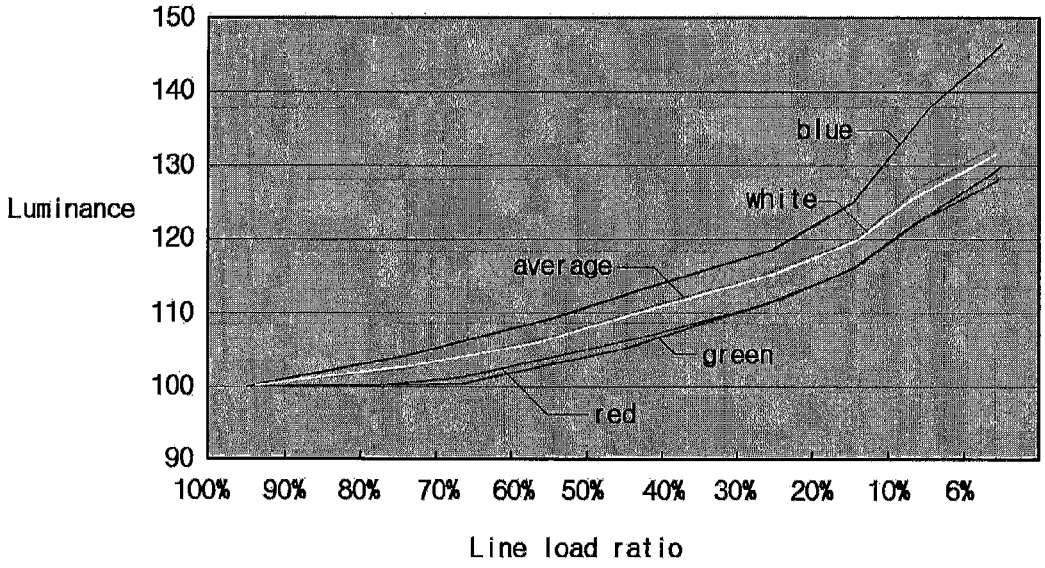
Figure 4C:
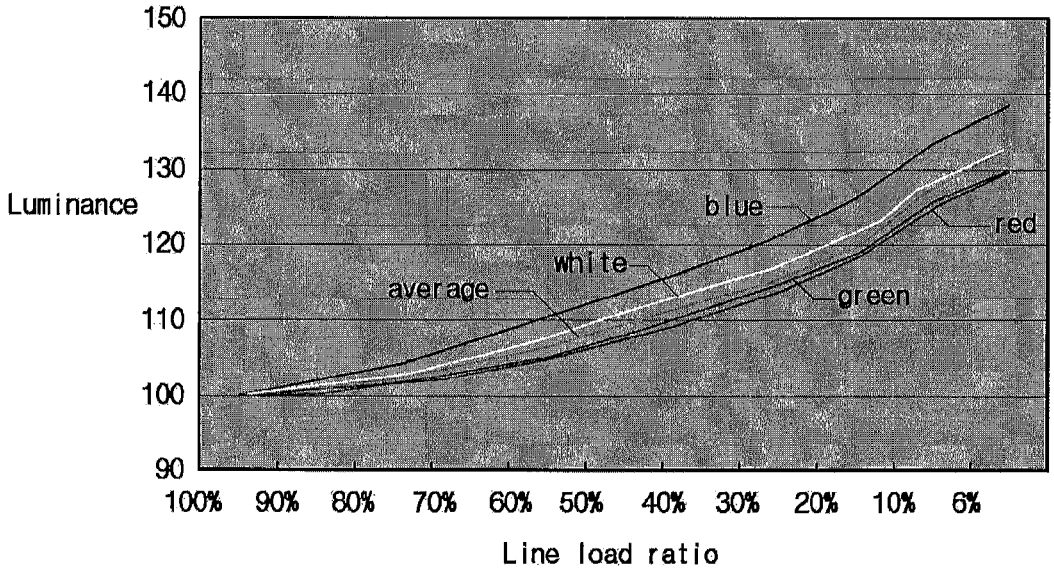

FIG. 3A shows a diagram representing a screen to be displayed, and FIG. 3B shows a diagram representing a screen seen and perceived by eye when the screen shown in FIG. 3A is actually being displayed. FIG. 4A, FIG. 4B, and FIG. 4C show graphs representing the luminance variations according to line load ratios.

As shown in FIG. 3A, when on a screen a quadrangle area 111 is illustrated in black and an area surrounding the quadrangle area is illustrated in white, the line load ratio of a row electrode passing through the quadrangle area 111 is less than the line load ratio of a row electrode that does not pass through the quadrangle area 111.

The number of turn-on cells on the row electrode having the higher load ratio is greater than the number of turn-on cells on the row electrode having the lower load ratio. Therefore, discharge currents according to the sustain discharge are increased on the row electrode having the higher load ratio, and a significant voltage drop occurs on the row electrode having the higher load ratio. As shown in FIG. 3B, white luminance of the row electrodes having the higher load ratio (the row electrodes that do not pass through the quadrangle area 111) is reduced to less than the white luminance of the row electrodes having the lower load ratio. That is, a luminance deviation occurs according to the load ratio for each electrode.

The luminance deviation may vary according to the screen load ratio shown in FIG. 4A, FIG. 4B, and FIG. 4C, because the discharge currents on the row electrodes vary according to the screen load ratio and the discharge currents affect the luminance.

In further detail, FIG. 4A, FIG. 4B, and FIG. 4C show graphs representing relative luminance variations according to the line load ratio when the screen load ratio is respectively 90%, 60%, and 30%. In the graphs, the vertical axis varies between 90 and 150 and shows a relative luminance assuming that the luminance is 100 when the line load ratio is 100%. The horizontal axis varies from 100% to less than 6%, and shows the value of the line load ratio. In addition, "red", "green", or "blue" labels for the relative luminance curves, respectively indicate cases that the red, green, or blue discharge cells are emitting light; a label of "white" indicates a relative luminance curve when the red, green, and blue discharge cells are emitting together; and a label "average" indicates an average value of the relative luminance for the red, green, and blue discharge cells.

From FIG. 4A, FIG. 4B, and FIG. 4C, it can be understood that the luminance is increased as the line load ratio of the row electrode is decreased, and the increase in luminance is different for the red, green, and blue discharge cells. In addition, the luminance also varies from figure to figure according to the screen load ratio that is decreasing from 90% in FIG. 4A to 60% in FIG. 4B and 30% in FIG. 4C.

A method for compensating the luminance deviation according to the first exemplary embodiment of the present invention will now be described with reference to FIG. 5, FIG. 6, FIG. 7A, and FIG. 7B.

Figure 5:
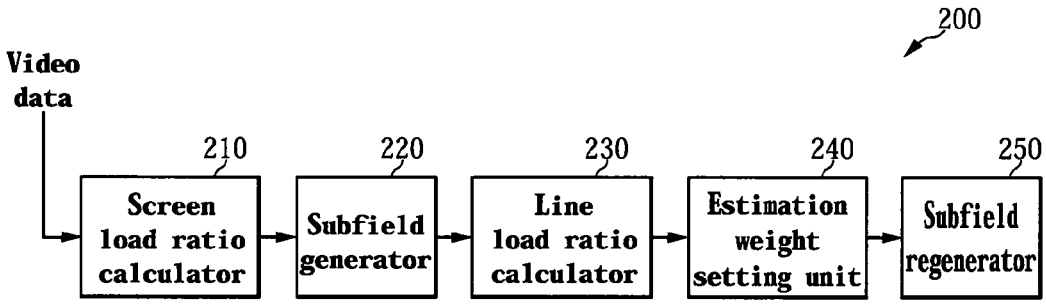
FIG. 5 shows a schematic block diagram of a controller according to the first exemplary embodiment of the present invention.

FIG. 5 shows a schematic block diagram of a controller 200 according to a first exemplary embodiment of the present invention. The controller 200 includes a screen load ratio calculator 210, a subfield generator 220, a line load ratio calculator 230, an estimation weight setting unit 240, and a subfield regenerator 250.

The screen load ratio calculator 210 calculates the screen load ratio from the video data input during one frame. For example, the screen load ratio calculator 210 may calculate the screen load ratio from an average signal level of the video data of one frame. To generate the subfield data, the subfield generator 220 converts the video data to the subfield data according to the luminance weights of the subfields SF1 to SF11. The line load ratio calculator 230 calculates the line load ratio of each row electrode for the subfields by using the corresponding subfield data. The line load ratio of each row electrode is calculated by using a ratio of the number of the turn-on cells to the number of all the discharge cells formed along the row electrode.

The estimation weight setting unit 240 determines an updated estimate of the weights of each of the plurality of subfields SF1 to SF11 for the row electrodes according to the line load ratio of each row electrode, and sets the updated estimate of the weight as a new weight. The updated weights of the subfields are also referred to as output estimation weights. The subfield regenerator 250 converts the video data to the subfield data according to the updated weight set by the estimation weight setting unit 240. In this case, the updated weight newly set by the estimation weight setting unit 240 is a virtual weight for regenerating the subfield data, and the number of sustain pulses is applied according to the initial luminance weight such as the exemplary set of weights shown in FIG. 2.

In addition, as described in the description of FIG. 4A to FIG. 4C, the relative luminance varies as a function of the line load ratio, the screen load ratio, and the phosphor color. Accordingly, the screen load ratio or the phosphor color, or both may also be used, in addition to the line load ratio, when the estimation weight setting unit 240 sets the updated subfield weights or the output estimation weights. For example, the estimation weight setting unit 240 may set the subfield weight by using a model 1, a model 2, a model 3, or a model 4. Only the line load ratio is used in model 1; the line load ratio and the phosphor color are used in model 2; the line load ratio and the screen load ratio are used in model 3; and the line load ratio, the screen load ratio, and the phosphor color are used in model 4.

In further detail, average variation ratios (average in FIG. 4A to FIG. 4C) obtained by averaging luminance variation ratios of red, green, and blue at each screen load ratio are averaged in respective screen load ratio conditions in the model 1. The luminance variation ratio is applied for the respective red, green, and blue in the model 2. For example, red luminance variation ratios (red in FIG. 4A to FIG. 4C) at each screen load ratio are averaged in the respective screen load ratio conditions. In the model 3 and model 4, the screen load ratio conditions are grouped into at least two groups, and the model 1 and the model 2 are averaged in each screen load ratio condition for each group. The models may be stored for each condition in the estimation weight setting unit 240 as a lookup table, or may be realized by a logic gate (e.g., a field programmable gate array (FPGA)). FIG. 4A, FIG. 4B, and FIG. 4C, when taken together show the variation of the relative luminance with all three factors of line load ratio that is shown along the horizontal axes, the phosphor colors that each have their corresponding curve, and the screen load ratio that varies from 90% in FIG. 4A to 60% in FIG. 4B and to 30% in FIG. 4C. The three separate drawings of FIG. 4A to FIG. 4C correspond to model 4 where the impact of each of the three parameters is shown separately. Model 2 and Model 3, each show the variation of the relative luminance with two of the three factors. In model 2, the variation is averaged over screen load ratio and in model 3 the variation is averaged over phosphor color. The average line appearing in each of the FIG. 4A to FIG. 4C corresponds to model 3 where the relative luminance is still shown as a function of the line load ratio and the screen load ratio but is averaged over the three colors such that only one average line appears corresponding to all three colors. There are no drawings for model 2. A drawing for model 2 would include one plot with three curves for each of the three colors where the curves are averaged over different screen load ratios. In model 1, the relative luminance would be shown only as a function of the line load ratio and would be averaged over both the three phosphor colors and the various screen load ratios. There are no drawings for model 1. Model 1 may be shown with one plot of relative luminance versus line load ratio that includes one curve only corresponding to an average relative luminance obtained by averaging over the relative luminance values of red, green, and blue phosphors and over the relative luminance values for screen load ratio of 30%, 60%, and 90%.

A method for resetting a subfield weight by using the above models by the estimation weight setting unit 240 will now be described with reference to FIG. 6, FIG. 7A, and FIG. 7B.

Figure 6:
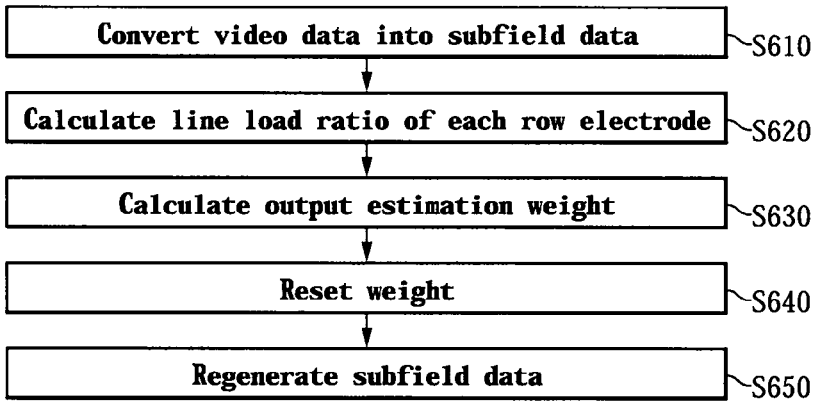
FIG. 6 shows a flowchart representing a method for compensating a luminance in the controller according to the first exemplary embodiment of the present invention.

FIG. 6 shows a flowchart representing a method for compensating the luminance in the controller according to the first exemplary embodiment of the present invention; FIG. 7A shows a diagram representing the subfield weights and subfield data before the luminance is compensated by the method shown in FIG. 6; and FIG. 7B shows a diagram representing the subfield weight and subfield data after the luminance is compensated by the method shown in FIG. 6.

For better understanding and ease of description, it is assumed that only 10 discharge cells are formed along one row electrode, and the luminance of video data of the first to the tenth discharge cells are respectively 5, 10, 15, 20, 25, 120, 140, 120, 80, and 20 as shown along the left column in FIG. 7A and FIG. 7B. Model 1 that is used in FIG. 7A and FIG. 7B is expressed by Equation 1 which is a regression equation.

$$NW_i = RW_i * (127.172 - 0.494366 * LR_i + 0.0022058 * LR_i^2)/100 \quad \text{[Equation 1]}$$

Where, $RW_i$ denotes an initial weight of an $i^{th}$ subfield SFi, $NW_i$ denotes a converted and updated weight of the $i^{th}$ subfield SFi, and $LR_i$ denotes a line load ratio of the $i^{th}$ subfield SFi. As explained above, model 1 expresses the relative luminance as a function of the line load ratio alone and is averaged over the other two parameters. Therefore, $NW_i$ may be expressed as a function of only $LR_i$ and a previous value of the subfield weight $RW_i$.

First, as shown in FIG. 6 and FIG. 7A, the subfield generator 220 converts the input video data into the subfield data in step S610, and the line load ratio calculator 230 calculates the line load ratio $LR_i$ of each row electrode for each subfield SFi in step S620. That is, the line load ratio calculator 230 outputs a ratio of the turn-on cells to all the discharge cells as the line load ratio $LR_i$ according to the subfield data, for each row electrode. As shown in FIG. 7A, for example, the line load ratio is 30% in a first subfield SF1 since there are 3 turn-on cells out of the total of 10 cells along the row, and the line load ratio is 100% in a second subfield SF2 since there are 10 turn-on cells out of the total 10.

The estimation weight setting unit 240 uses a predetermined model (e.g., Equation 1), calculates an output estimation weight (updated weight) according to the line load ratio for each of the subfields SF1 to SF11 in step S630, and sets the calculated output estimation weight as a new weight $NW_i$ for regenerating the subfield data in step S640. The regenerated and updated output estimation weights are shown as the last row of FIG. 7A. These updated weights become the new weights of each of the subfields as shown as the second row of FIG. 7B. The subfield regenerator 250 regenerates the subfield data according to the updated new weight $NW_i$ in step S650, as shown in FIG. 7B.

The new weight $NW_i$ set by the estimation weight setting unit 240 is for regenerating the subfield data, and the number of sustain pulses applied to the subfields SF1 to SF11 when an image is actually displayed is determined by the initial weight $RW_i$. The initial weight $RW_i$ for each subfield is shown as the second row of FIG. 7A.

Referring back to FIG. 7A, there is a large error between a target luminance and an actual luminance as shown in the last four columns of the figure. In FIG. 7A, the actual luminance is calculated by using the calculated output estimation weight $NW_i$ in the predetermined model for the respective subfields and the subfield data. As shown in FIG. 7B, after the luminance is compensated, the error between the actual luminance and the target luminance is reduced. In this case, the actual luminance shown in FIG. 7B is obtained when an image is displayed by using the subfield data that is regenerated in step S650. That is, the actual luminance is obtained according to the line load ratio determined by the regenerated subfield data and the output estimation weight in each subfield determined by Equation 1.

As described, according to the first exemplary embodiment of the present invention, the weight of each subfield is reset according to the line load ratio, and the subfield data are regenerated according to the reset weight to compensate the luminance.

However, the luminance error may be increased in the luminance compensation method according to the first exemplary embodiment of the present invention. This increase will now be described with reference to FIG. 8A and FIG. 8B.

FIG. 8A shows a diagram representing the subfield weight and the subfield data before the luminance is compensated in the method shown in FIG. 6, and FIG. 8B shows a diagram representing the subfield weight and subfield data after the luminance is compensated in the method shown in FIG. 6. In FIG. 8A and FIG. 8B, it is assumed that a 250 grayscale accounts for 17% of one row electrode and a 50 grayscales account for 83% of the one row electrode.

When the model given as Equation 1 is used, the output estimation weights of the respective subfields are given as in FIG. 8A. That is, the actual weight and the output estimation weight are the same in the subfield having a line load ratio of 100%, but the output estimation weight is higher than the actual weight in the subfield having a line load ratio of less than 100%. In the above condition, the actual luminance of a 50 grayscale is 50, which is the same as the target luminance, but a great difference is generated between the actual luminance and the target luminance of the 250 grayscale since the actual luminance is 289.

In this case, FIG. 8B shows that a new weight is set and the subfield data are regenerated according to the first exemplary embodiment of the present invention. When the output estimation weight is calculated again to calculate the actual luminance, the error between the actual and target luminance is reduced since the target luminance of the 250 grayscale is now 256.54, but an error between the actual and target luminance is generated since the target luminance of the 50 grayscale is now 45.54. Particularly, since the line load ratio of an eighth subfield SF8 is greatly changed by the change of the subfield data of the 50 grayscale, there is a great difference between the set weight (33.42) and the output estimation weight 28.4 of the subfield SF8. Accordingly, a large difference is generated in the target luminance.

An exemplary embodiment for reducing the difference in the present invention will now be described with reference to FIG. 9, FIG. 10, and FIG. 11.

Figure 9:
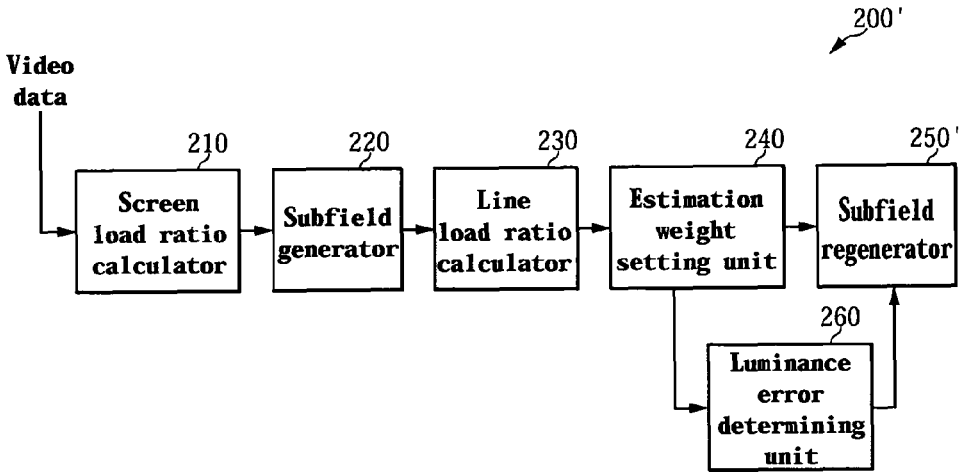
FIG. 9 shows a schematic diagram of a controller according to a second exemplary embodiment of the present invention.
Figure 10:
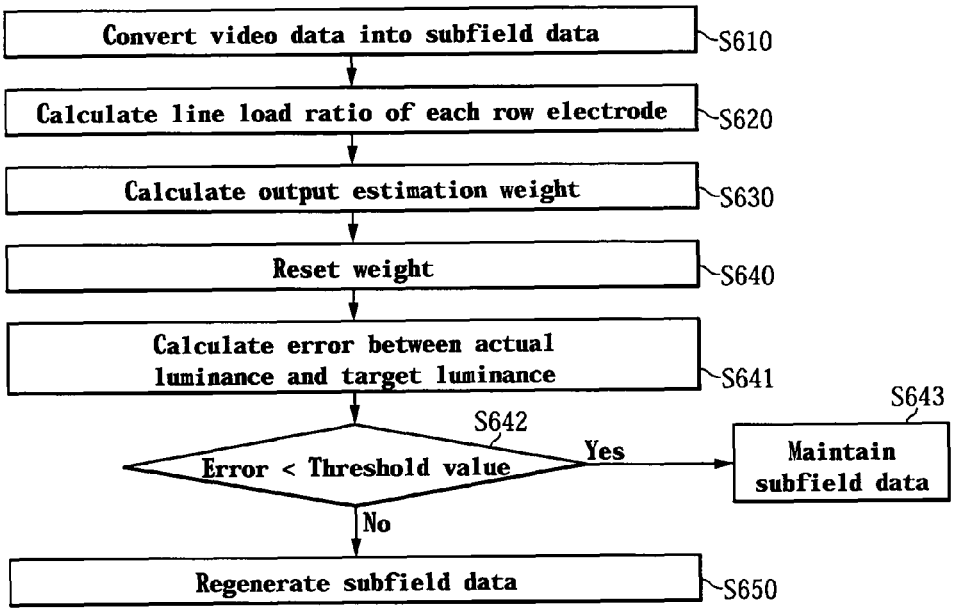
FIG. 10 shows a flowchart representing a luminance compensation method according to the second exemplary embodiment of the present invention.

FIG. 9 shows a schematic diagram of a controller 200' according to a second exemplary embodiment of the present invention, and FIG. 10 shows a flowchart representing a luminance compensation method according to the second exemplary embodiment of the present invention. FIG. 11 shows a diagram representing the subfield data after the data shown in FIG. 8A are compensated by the method shown in FIG. 10.

As shown in FIG. 9, the controller 200' according to the second exemplary embodiment of the present invention is similar to the controller 200 of the first embodiment. The controller 200' of the second embodiment, however, further includes a luminance error determining unit 260. Moreover, the function of a subfield data generator 250' of the controller 200' is different from the function of the subfield data generator 250 of the controller 200 of the first exemplary embodiment of the present invention.

In further detail, as shown in FIG. 10, after the subfield weight is determined in steps S610 to S640 as described in the written description of FIG. 6, in step S641 the luminance error determining unit 260 calculates an error between the actual luminance and the target luminance for the respective grayscales of the plurality of discharge cells of each row electrode. In step S642, the luminance error determining unit 260 determines whether the calculated error is less than a threshold value for a corresponding grayscale. In step S643, the subfield regenerator 250' does not regenerate the subfield data for the grayscales having an error that is less than the threshold value. Rather, in step S650, the subfield generator 250' regenerates the subfield data according to the new weight $NW_i$ for the grayscales having an error that is greater than the threshold value.

In this case, the threshold value may be equally set for all the grayscales, or a relatively greater threshold value may be set for the higher grayscales. The threshold value for an error ratio may be equally set for all the grayscales. In this case, the error ratio corresponds to an error between the actual luminance and the target luminance divided by the target luminance.

Referring back to FIG. 8A, when the difference between the actual luminance and the target luminance is larger for grayscale 250 and smaller for grayscale 50, if according to the approach of the second embodiment, the subfield data are generated only for the 250 grayscale and not for the 50 grayscale, then the results appear in FIG. 11. A comparison between FIG. 8B and FIG. 11 shows that by using the approach of the second embodiment, the error between the target luminance and the actual luminance for the 250 and 50 grayscales is reduced.

Referring back to FIG. 8A and FIG. 8B, when the line load ratio of the 50 grayscale is 83%, corresponding to SF3, a subfield formation used to express the 50 grayscale affects the line load ratio. Accordingly, an error occurs since the line load ratio of each subfield is changed when the subfield formation of the 50 grayscale that affects the line load ratio is changed as shown in FIG. 8B. Accordingly, the error may be reduced when the subfield formation is maintained in such grayscales. This approach will now be described according to a third embodiment of the present invention with reference to FIG. 12, FIG. 13, and FIG. 14.

Figure 12:
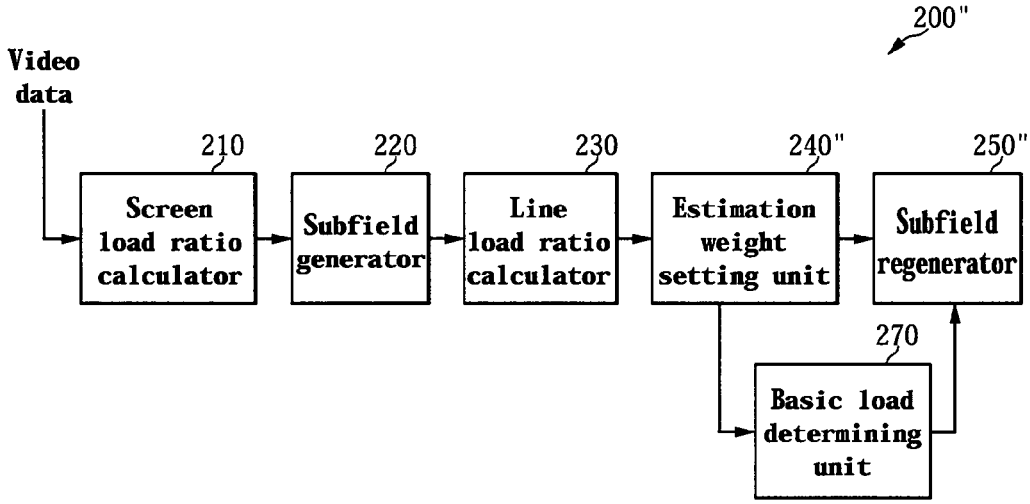
FIG. 12 shows a schematic block diagram of a controller according to a third exemplary embodiment of the present invention.
Figure 13:
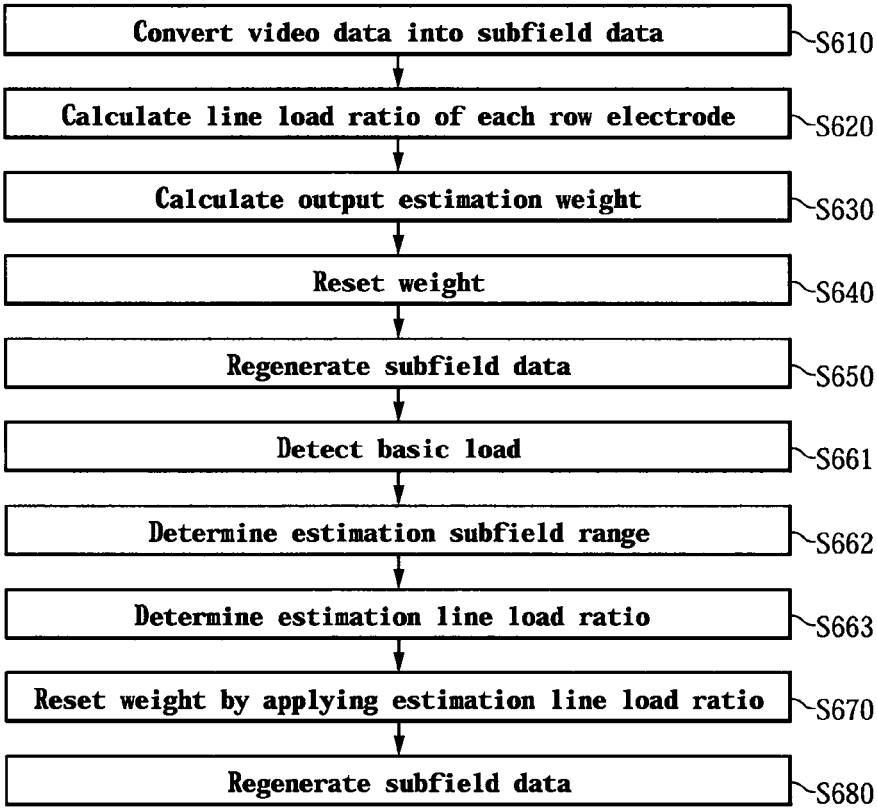
FIG. 13 shows a flowchart representing a luminance compensation method according to the third exemplary embodiment of the present invention.

FIG. 12 shows a schematic block diagram of a controller 200" according to the third exemplary embodiment of the present invention, and FIG. 13 shows a flowchart representing a luminance compensation method according to the third exemplary embodiment of the present invention.

As shown in FIG. 12, the controller 200" according to the third exemplary embodiment of the present invention is similar to the controller 200 of the first embodiment. However, the controller 200" further includes a basic load determining unit 270. Further, the functions of an estimation weight setting unit 240" and a subfield regenerator 250" are different from those included in the controllers 200 and 200' of the first and second exemplary embodiments of the present invention. A subfield group has a load ratio for affecting the luminance, and the subfield formation of the subfield group may be changed by the compensation method according to the first exemplary embodiment of the present invention shown in FIG. 6. Hereinafter, the subfield groups having similar subfield data patterns will be referred to as "basic loads." The subfields forming a basic load may change after each update of the luminance weights of the subfields in order to maintain the load ratio of the basic load.

The basic load determining unit 270 detects the basic load from the line load ratio determined according to the initial weight and the line load ratio after the compensation is performed by the estimation weight setting unit 240" and the subfield regenerator 250". The basic load determining unit 270 then sets a subfield range affected by the basic load (hereinafter, called an "estimation subfield range"). The basic load determining unit 270 assumes the line load ratio of the basic load as an estimation line load ratio of a subfield in an estimation subfield range. The estimation weight setting unit 240" resets the subfield weights based on the estimation line load ratio from the basic load determining unit 270. The subfield regenerator 250" regenerates the subfield data according to the reset subfield weight.

As shown in FIG. 13, the subfield regenerator 250" regenerates the subfield data in step S650 after steps S610 to S640 occur as described in FIG. 6 with steps S630 and S640 being performed by the estimation weight setting unit 240". Then, the basic load determining unit 270 detects the basic load in steps S661 to S663. Hereinafter, the subfield data generated by the subfield generator 220 according to the initial weight, in step S620, will be referred to as "initial subfield data," and the subfield data regenerated by the subfield regenerator 250" in step S650 will be referred to as "first subfield data."

Figure 14:
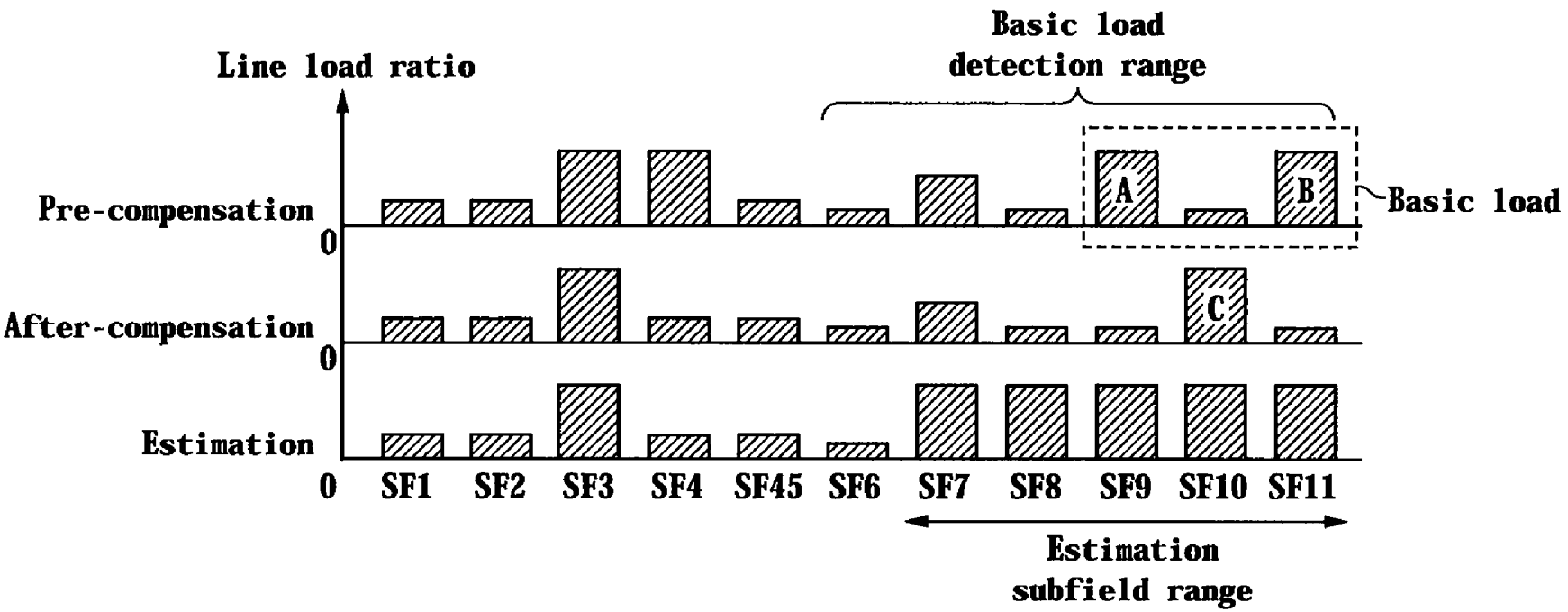
FIG. 14 shows a diagram representing a basic load detection method according to the third exemplary embodiment of the present invention.

In further detail, in step S661, the basic load determining unit 270 detects whether a subfield located among subfields of a basic load detection range may be categorized as a basic load or as part of a basic load group of subfields. As shown in FIG. 8A and FIG. 8B, the luminance is affected more significantly when the line load ratio is changed in a subfield having a high weight. Therefore, the subfields having the higher weights are set as the basic load detection subfields, according to the third exemplary embodiment of the present invention. For example, as shown in FIG. 14, six subfields of SF6 to SF11 having the six highest weights, amongst all of the subfields SF1 to SF11, may be set as the basic load detection subfields or the basic load detection range. The basic load determining unit 270, therefore, looks for the subfield or the group of subfields forming the basic load among the basic load detection range. As shown in FIG. 14, the basic load determining unit 270 compares the line load ratio determined by the initial subfield data (hereinafter, referred to as a "pre-compensation line load ratio") to the line load ratio determined by the first subfield data (hereinafter, referred to as an "after-compensation line load ratio") in the basic load detection range of subfields. Subfields, within the basic load detection range, having an error between the two line load ratios that is greater than a threshold value may be determined as the basic load group including subfields SF9, SF10, and SF11. The same threshold value may be set for all the subfields. Alternatively, a low threshold value may be set for a subfield having a higher weight since data of the subfield having the higher weight have a greater effect on the luminance.

Subsequently, the basic load determining unit 270 determines a range of subfields (i.e., an estimation subfield range) that may be affected by the subfields in the basic load in step S662. In this case, the estimation subfield range includes the subfields forming the basic load, and may further include one or more subfields neighboring the subfields forming the basic load. That is, since the load of a subfield having a weight that is higher than the highest weight of the basic load may vary according to the variation of the basic load, the estimation subfield range may include a subfield having a lowest weight among subfields having a weight that is higher than the highest weight of the basic load. In addition, since the load of a subfield having a weight that is lower than the lowest weight of the basic load may vary according to the variation of the basic load, the estimation subfield range may include one or two subfield having a highest weight among subfields having a weight that is lower than the lowest weight of the basic loads.

Subsequently, in step S663, the basic load determining unit 270 determines the estimation line load ratio of the subfields in the estimation subfield range based on the line load ratio of the basic load. In this case, when there is only one subfield in the basic load group of subfields, the basic load determining unit 270 sets the estimation line load ratio of the subfields in the estimation subfield range to be equal to the higher of the pre-compensation and the after-compensation line load ratios of that one subfield. When there are more than two subfields in the basic load, as shown in FIG. 14, the basic load determining unit 270 sets the estimation line load ratio for all the subfields within the estimation subfield range equal to an average of the higher of the pre-compensation and after-compensation line load ratios of the subfields forming the basic load. In other words, first the higher line load ratio for each subfield within the subfields forming the basic load is determined. The higher line load ratio for SF9, SF10, and SF11 are shown, respectively as A, B, and C. Next, these higher line load ratios are averaged and the one average value is set as the estimation line load ratio of all the subfields within the estimation subfield range. For the case shown in FIG. 14, (A+B+C)/3 would be set as the line load ratio of all of the subfields within the estimation subfield range. The estimation line load ratio of the subfields outside the estimation subfield range remains at the after-compensation line load ratio.

The estimation weight setting unit 240" uses the line load ratio set by the basic load determining unit 270 and the above model, and determines the updated subfield weight in step S670. In this case, the estimation line load ratio is used for the subfields in the estimation subfield range, and the after-compensation line load ratios are used for the other subfields.

In step S680, the subfield regenerator 250" regenerates the subfield data according to the subfield weights that were determined in step S670 by the estimation weight setting unit 240" based on the basic load. In this case, since the line load ratio of the subfields in the estimation subfield range is set high, there is no great change in the weights of the subfields as a result of the resetting of the weights in step S670. Accordingly, since there is no great change in the subfield data of the subfields in the estimation subfield range, the subfield data that is affected by the basic load may be maintained.

As described, according to the second and third exemplary embodiments of the present invention, since the subfield data used for formation of a subfield having a high line load ratio is not greatly changed, an error caused by inaccurate compensation of the luminance may be avoided.

According to the exemplary embodiments of the present invention, when the luminance is not changed according to the line load ratio, a predetermined luminance may be maintained for the same grayscales regardless of the line load ratio.

While this invention has been described in connection with certain exemplary embodiments, it is to be understood that the invention is not limited to the disclosed embodiments, but, on the contrary, is intended to cover various modifications and arrangements included within the spirit and scope of the appended claims and their equivalents.

What is claimed is:

1. A driving method of a plasma display device having a plurality of row electrodes, a plurality of column electrodes, and a plurality of discharge cells defined by the plurality of row electrodes and the plurality of column electrodes, the plasma display device being driven during frames of time, the driving method comprising:

dividing each of the frames of time into a plurality of subfields each having a sustain period with a corresponding fixed sustain period length and initial luminance weight, the sustain period length corresponding to the initial luminance weight;

determining, for each of the plurality of subfields, a first line load ratio from a plurality of video signals corresponding to a first row electrode among the plurality of row electrodes, the first row electrode having a plurality of first row discharge cells among the plurality of discharge cells, the first line load ratio corresponding to a number of the first row discharge cells that are to emit light among a total number of the first row discharge cells;

setting, for each of the plurality of subfields, a first output estimation weight according to the first line load ratio, the first output estimation weight being an updated luminance weight;

converting the plurality of video signals corresponding to the first row electrode into a plurality of first subfield data according to the first output estimation weight set for each of the plurality of subfields, each of the plurality of first subfield data for indicating which of the first row discharge cells are to emit light during a corresponding one of the plurality of subfields;

applying driving control signals to the first row electrode and the plurality of column electrodes according to the plurality of first subfield data and the sustain period length of each of the plurality of subfields;

calculating a screen load ratio from the plurality of video signals corresponding to one of the frames of time; and generating at least one model adapted to predict variation of output luminance as a function of variation of line load ratio, wherein for each of the plurality of subfields, the setting of the first output estimation weight comprises calculating the first output estimation weight from the corresponding initial luminance weight and the first line load ratio according to the at least one model.

2. The driving method of claim 1, further comprising:

mapping the plurality of video signals corresponding to the first row electrode into the plurality of subfields according to the corresponding initial luminance weight of each of the plurality of subfields; and converting the mapping of the plurality of video signals into a plurality of initial subfield data, each of the plurality of initial subfield data for indicating which of the first row discharge cells are to emit light during a corresponding one of the plurality of subfields, wherein, for each of the plurality of subfields, the determining of the first line load ratio from the plurality of video signals comprises determining the first line load ratio from a corresponding one of the plurality of initial subfield data.

3. The driving method of claim 1, wherein the at least one model comprises a model independent of a screen load ratio calculated from a video signal corresponding to one of the frames of time.

4. The driving method of claim 3, wherein the plurality of discharge cells comprises a plurality of first discharge cells for emitting a first color and a plurality of second discharge cells for emitting a second color, and wherein the at least one model includes a first model corresponding to the first color and a second model corresponding to the second color.

5. The driving method of claim 1, further comprising calculating the screen load ratio from a plurality of possible screen load ratios, wherein the plurality of possible screen load ratios are divided into a first pluralityof groups according to a first plurality of representative screen load ratios, each of the groups corresponding to one of the representative screen load ratios, and wherein the at least one model comprises a plurality of first models each corresponding to one of the groups.

6. The driving method of claim 5, wherein the plurality of discharge cells comprises a plurality of first discharge cells for emitting a first color and a plurality of second discharge cells for emitting a second color, and wherein each of the plurality of first models comprises a second model corresponding to the first color and a third model corresponding to the second color.

7. The driving method of claim 1, wherein the converting of the video signals into the plurality of first subfield data includes mapping the plurality of video signals corresponding to the first row electrode into the plurality of subfields according to the first output estimation weight corresponding to each of the plurality of subfields.

8. A plasma display device for driving during frames of time, the plasma display device comprising:

a row electrode corresponding to a plurality of discharge cells located along the row electrode;

a controller adapted to divide one of the frames of time into a plurality of subfields having corresponding fixed sustain period lengths and initial luminance weights, the sustain period lengths corresponding to respective said initial luminance weights, map a plurality of video signals corresponding to the plurality of discharge cells into the plurality of subfields according to the corresponding initial luminance weights, convert the map of video signals into a plurality of first subfield data, each of the plurality of first subfield data for indicating which of the discharge cells are to emit light during a corresponding one of the plurality of subfields, calculate a screen load ratio from the plurality of video signals corresponding to the one of the frames, determine a line load ratio for each of the plurality of subfields from a respective portion of the plurality of first subfield data, select at least one model adapted to predict variation of output luminance as a function of variation of line load ratio, compensate the plurality of first subfield data, according to the line load ratio and a respective one of the initial luminance weights of each of the plurality of subfields, according to the at least one model, and generate a plurality of second subfield data, each of the plurality of second subfield data for indicating which of the discharge cells are to emit light during a corresponding one of the plurality of subfields, according to the compensation of the plurality of first subfield data; and a driver adapted to discharge a plurality of turn-on cells during the plurality of subfields according to respective said second subfield data and respective said sustain period lengths.

9. The plasma display device of claim 8, wherein the controller comprises:

an estimation weight setting unit adapted to determine an output estimation weight for each of the plurality of subfields according to a respective said line load ratio; and a subfield generator adapted to generate the plurality of second subfield data according to the output estimation weight of each of the plurality of subfields.

10. The plasma display device of claim 9, wherein the output estimation weight of each of the plurality of subfields corresponds to an output luminance having the respective line load ratio and a respective one of the sustain period lengths.

11. A plasma display device for driving during frames of time, the plasma display device comprising:

a plurality of row electrodes each corresponding to a plurality of discharge cells;

a controller adapted to divide one of the frames of time into a plurality of subfields having respective fixed sustain period lengths and initial luminance weights, the sustain period lengths corresponding to the respective initial luminance weights, calculate a screen load ratio from a plurality of video signals corresponding to the one of the frames, calculate a line load ratio from the plurality of video signals for each of the plurality of subfields of each of the plurality of row electrodes, compensate the plurality of video signals of the plurality of discharge cells corresponding to each of the plurality of row electrodes according to the screen load ratio and the line load ratio of each of the plurality of subfields of each of the plurality of row electrodes, and generate subfield data for indicating which of the discharge cells of each of the plurality of row electrodes are to emit light during each of the plurality of subfields according to the compensation of the plurality of video signals; and a driver adapted to discharge a plurality of turn-on cells during the plurality of subfields according to the subfield data and the respective sustain period lengths.

12. The plasma display device of claim 11, wherein the controller is further adapted to convert a video signal of a first grayscale corresponding to a row electrode having a first line load ratio into first subfield data in a first frame having a first screen load ratio, and wherein the controller is further adapted to convert a video signal of a second grayscale corresponding to a row electrode having a second line load ratio into second subfield data in a second frame having a second screen load ratio, the second grayscale being equal to the first grayscale, the second line load ratio being equal to the first line load ratio, the second subfield data being different from the first subfield data, and the second screen load ratio being different from the first screen load ratio.

13. The plasma display device of claim 11, wherein the controller is further adapted to convert a video signal of a first grayscale corresponding to a row electrode having a first line load ratio into first subfield data, and to convert a video signal of a second grayscale corresponding to a row electrode having a second line load ratio into second subfield data, the second grayscale being equal to the first grayscale, the second line load ratio being different from the first line load ratio, and the second subfield data being different from the first subfield data.

14. The plasma display device of claim 11, wherein the controller comprises:

an estimation weight setting unit adapted to determine an output estimation weight for each of the plurality of subfields of each of the plurality of row electrodes according to a respective said line load ratio; and a subfield regenerator adapted to generate the subfield data according to the output estimation weight of each of the plurality of subfields of each of the plurality of row electrodes.

15. A plasma display device for driving during frames of time, the plasma display device comprising:

a row electrode corresponding to a plurality of first discharge cells for emitting a first color and a plurality of second discharge cells for emitting a second color;

a controller adapted to divide one of the frames of time into a plurality of subfields having respective fixed sustain period lengths and initial luminance weights, the sustain period lengths corresponding to respective said initial luminance weights, calculate, for each of the plurality of subfields of the row electrode, a line load ratio from a plurality of video signals comprising a plurality of first video signals and a plurality of second video signals respectively corresponding to the plurality of first discharge cells and the plurality of second discharge cells, calculate a screen load ratio from the plurality of video signals corresponding to the one of the frames, select at least one model adapted to predict variation of output luminance as a function of variation of line load ratio, respectively compensate the plurality of first video signals of the plurality of first discharge cells and the plurality of second video signals of the plurality of second discharge cells for each of the plurality of subfields according to a respective said line load ratio and a respective one of the initial luminance weights, and according to color, according to the at least one model, and generate a plurality of subfield data, each of the plurality of subfield data for indicating which of the first discharge cells and the second discharge cells are to emit light during a corresponding one of the plurality of subfields, according to the compensation of the plurality of first video signals and the plurality of second video signals; and a driver adapted to discharge a plurality of tum-on cells during the plurality of subfields according to respective said subfield data and the respective sustain period lengths.

16. The plasma display device of claim 15, wherein the controller is further adapted to convert a video signal of a first grayscale corresponding to one of the plurality of first discharge cells of the row electrode into first subfield data, and wherein the controller is further adapted to convert a video signal of a second grayscale corresponding to one of the plurality of second discharge cells of the row electrode into second subfield data, the second subfield data being different from the first subfield data, the second grayscale being equal to the first grayscale.

17. The plasma display device of claim 15, wherein the controller comprises:

an estimation weight setting unit adapted to determine an output estimation weight for each of the plurality of subfields according to the respective line load ratio; and a subfield regenerator adapted to generate the plurality of subfield data according to the output estimation weight of each of the plurality of subfields.

* * * * *